US009695022B2

(12) United States Patent
Versteyhe et al.

(10) Patent No.: US 9,695,022 B2
(45) Date of Patent: Jul. 4, 2017

(54) DEVICE AND CONTROL METHOD FOR CONTAINER LOCKING

(71) Applicant: DANA LIMITED, Maumee, OH (US)

(72) Inventors: Mark R. J. Versteyhe, Oostkamp (BE); Evrim Taskiran, Brussels (BE)

(73) Assignee: Dana Limited, Maumee, OH (US)

( * ) Notice: Subject to any disclaimer, the term of this patent is extended or adjusted under 35 U.S.C. 154(b) by 0 days.

(21) Appl. No.: 14/392,095

(22) PCT Filed: Apr. 10, 2014

(86) PCT No.: PCT/US2014/033611
§ 371 (c)(1),
(2) Date: Oct. 7, 2015

(87) PCT Pub. No.: WO2014/169096
PCT Pub. Date: Oct. 16, 2014

(65) Prior Publication Data

US 2016/0031688 A1 Feb. 4, 2016

Related U.S. Application Data

(60) Provisional application No. 61/811,207, filed on Apr. 12, 2013.

(51) Int. Cl.

| | |
|---|---|
| ***B66F 9/075*** | (2006.01) |
| ***B66C 13/46*** | (2006.01) |
| ***B66C 19/00*** | (2006.01) |
| ***B66F 9/20*** | (2006.01) |

(52) U.S. Cl.
CPC ..... *B66F 9/0755* (2013.01); *B66C 13/46* (2013.01); *B66C 19/007* (2013.01); *B66F 9/20* (2013.01)

(58) Field of Classification Search
None
See application file for complete search history.

(56) References Cited

U.S. PATENT DOCUMENTS

| | | | | |
|---|---|---|---|---|
| 6,081,292 | A | 6/2000 | Lanigan, Jr. et al. | |
| 6,968,963 | B1 | 11/2005 | Zakula, Sr. et al. | |
| 2012/0092643 | A1* | 4/2012 | Rintanen | B66C 13/46 356/4.01 |

FOREIGN PATENT DOCUMENTS

| | | | |
|---|---|---|---|
| DE | 102004041938 | A1 | 3/2006 |
| WO | 01/81233 | A1 | 11/2001 |

OTHER PUBLICATIONS

European Patent Office; The International Search Report and Written Opinion; Jun. 19, 2014; 9 pages; European Patent Office, Rijswijk, Netherlands.

* cited by examiner

*Primary Examiner* — Adam Tissot
*Assistant Examiner* — Tamara Weber
(74) *Attorney, Agent, or Firm* — Marshall & Melhorn, LLC

(57) ABSTRACT

A method for selecting a trajectory for container locking uses at least one twistlock sensor on a machine to sense a location of a twist lock hole on an object. The sensed location is transmitted to a processor to calculate a sensed trajectory for a twistlock to engage the twist lock hole. At least one operator input sensor is used to sense an input from an operator moving the twist lock to engage the twist lock hole. The sensed operator input is transmitted to the processor to calculate an operator trajectory for the twist lock to engage the twist lock hole. The sensed trajectory is compared with the operator trajectory to determine which should be used.

7 Claims, 5 Drawing Sheets

DEVICE AND CONTROL METHOD FOR CONTAINER LOCKING

RELATED APPLICATIONS

This application claims the benefit of U.S. patent application Ser. No. 61/811,207 filed on Apr. 12, 2013 which is incorporated by reference herein.

TECHNICAL FIELD

Described herein is a device and control method to assist an operator in handling loads with a machine equipped with twistlocks. The machine may be such as a telescopic boom, a crane or a spreader on a reach stacker, but other devices are permissible as well. More specifically, described is a method and device to position the twistlocks into the twistlock holes of an ISO-container and to execute the locking operation. The positioning of the twistlocks can be done with just operator input, control device input or a combination of both.

BACKGROUND

A reach stacker is a vehicle used for handling intermodal cargo containers (ISO containers) in small and medium-sized ports. Reach stackers are able to transport a container short distances very quickly and stack them. Reach stackers are widely used for container stacking because of their flexibility, higher stacking and lifting and container handling capacity when compared to forklift trucks. Using reach stackers, container blocks can have a depth of 4 to 6 row of containers, due to second/third row access. Furthermore, containers can be stacked typically up to 5 containers high.

When a container on the top of a row has to be manipulated, the operator has to maneuver the reach stacker in front of the container block, extend the boom and position the spreader over the container surface. Finally, the twistlock mechanisms on the spreader have to be positioned above the matching holes in the corners of the container and subsequently moved and locked into the holes.

FIG. 1 depicts one embodiment of a container 10 with twistlock holes 12. FIG. 2A depicts a twistlock 14 in an unlocked position, but not engaged with a twistlock hole 12, and FIG. 2B depicts the twist lock 14 in a locked position, but also not engaged with a twistlock hole 12.

It can be appreciated from FIGS. 2A and 2B, that the twistlock 14 has an upper portion 16 and a lower portion 18. The lower portion 18 is fixed, while the upper portion 16 can be selectively rotated. In the unlocked position, the upper portion 16 is aligned with the lower portion 18. In the locked position, the upper portion 16 is turned with respect to the lower portion 18, so that the upper portion 16 extends over and beyond the lower portion 18. The upper portion 16 may be turned approximately 90 degrees with respect to the lower portion 18 so that the upper portion 16 extends beyond the perimeter of the lower portion 18.

The twistlock 14 is dimensioned to fit into the twistlock hole 12. Once in the hole 12, the upper portion 16 is rotated. The rotated upper portion 16 engages with the material surrounding the hole 12 to lock the upper portion 16 to the container 10.

The operator has to perform the entire operation from ground level while the container 10 is positioned at heights in excess of 15 m. Typically the operator has no feedback during the operation, however, the operator does get a confirmation once the twistlock 14 is engaged. It can therefore be appreciated that the time to locate the twistlock 14 into the hole 12 largely depends on operator experience. Even experienced, trained operators can take a considerable amount of time to locate the twistlock 14 into a container hole 12.

While the above discussion is focused on reach stackers, twistlocks 14 are not limited to reach stackers. Instead, several other kinds of vehicles, such as empty-container handlers, container stackers and material handling equipment, such as gantry cranes, use twistlocks. The solution proposed herein to the current disadvantageous method of using twistlocks applies to these applications as well.

Several companies in the market offer systems that help operators in the locking operation. One of such commercial systems is called View-on-twistlocks' by Orlaco. The View-on-twistlocks system consists of cameras fitted on either side of the spreader and aimed at the twistlocks. Each camera displays its images on its own monitor.

This system has some major drawbacks that include, but are not limited to, the need to use multiple high resolution cameras, each camera needs its own display, or one display capable of combining all of the camera images, the cameras and displays are expensive, the operation is entirely performed by the operator, and the operator must focus all of his attention on the screen(s), which can lead to accidents because the driver can't also pay attention to his surroundings.

An automatic method to detect the twistlock holes, move the spreader twistlocks towards these holes and achieve the locking is thus desirable. Fully autonomous locking is however not necessary in most cases, as the operator needs to stay in control for safety reasons and to obtain a smooth handling sequence of the total operation.

To solve the problem associated with the prior art three steps may be used. First, the location of the twistlock hole position is detected. Second, a method of control to guide the twistlocks to the hole position is needed. Lastly, an actuation mechanism incorporating the necessary sensor input, operator input, control algorithm, and actuator signal is needed.

SUMMARY OF THE PRESENT DISCLOSURE

A method for selecting a trajectory based on two inputs uses at least one twistlock sensor on a machine to sense the location of a twistlock hole on an object. The sensed location is transmitted to a processor to calculate a sensed trajectory for a twistlock to engage the twistlock hole. Using at least one operator input sensor to sense an operator created trajectory to engage the twistlock with the twistlock hole. The sensed trajectory is compared with the operator created trajectory. A determination is made of how much of the sensed trajectory and the operator created trajectory will be used to locate the twistlock into the twistlock hole in the object.

BRIEF DESCRIPTION OF THE DRAWINGS

Exemplary embodiments of the present disclosure will now be described by way of example with reference to the accompanying drawings, in which.

DETAILED DESCRIPTION OF EXEMPLARY EMBODIMENTS

Described herein is a method to optionally obtain a shared control between an electronic controller and a human operator. To this end, data from a single sensor or a combination of detection systems is extracted. The sensor system 20 can be a single or multiple digital cameras, from which the container 10 can be precisely monitored by taking images with a preferred refresh rate. The refresh rate may be such as 10-30 frames per second, but other refresh rates are permissible as long as they provide accurate and contemporaneous information regarding for the operations described below.

Figure 1:
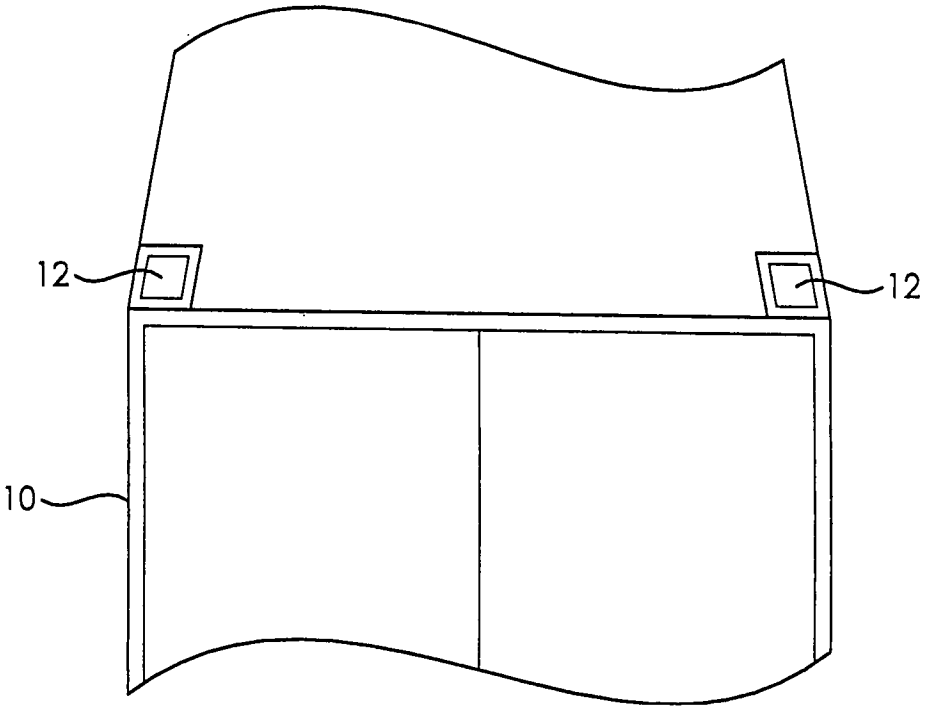
FIG. 1 is a perspective view of one embodiment of a container and twistlock holes.
Figure 2B:
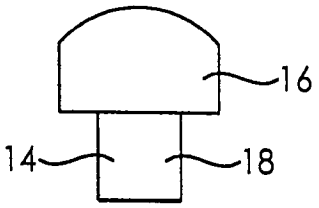
FIG. 2B is one embodiment of a twistlock in a locked position.
Figure 2A:
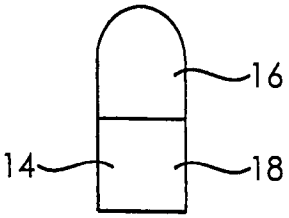
FIG. 2A is a one embodiment of a twistlock in an unlocked position.
Figure 3:
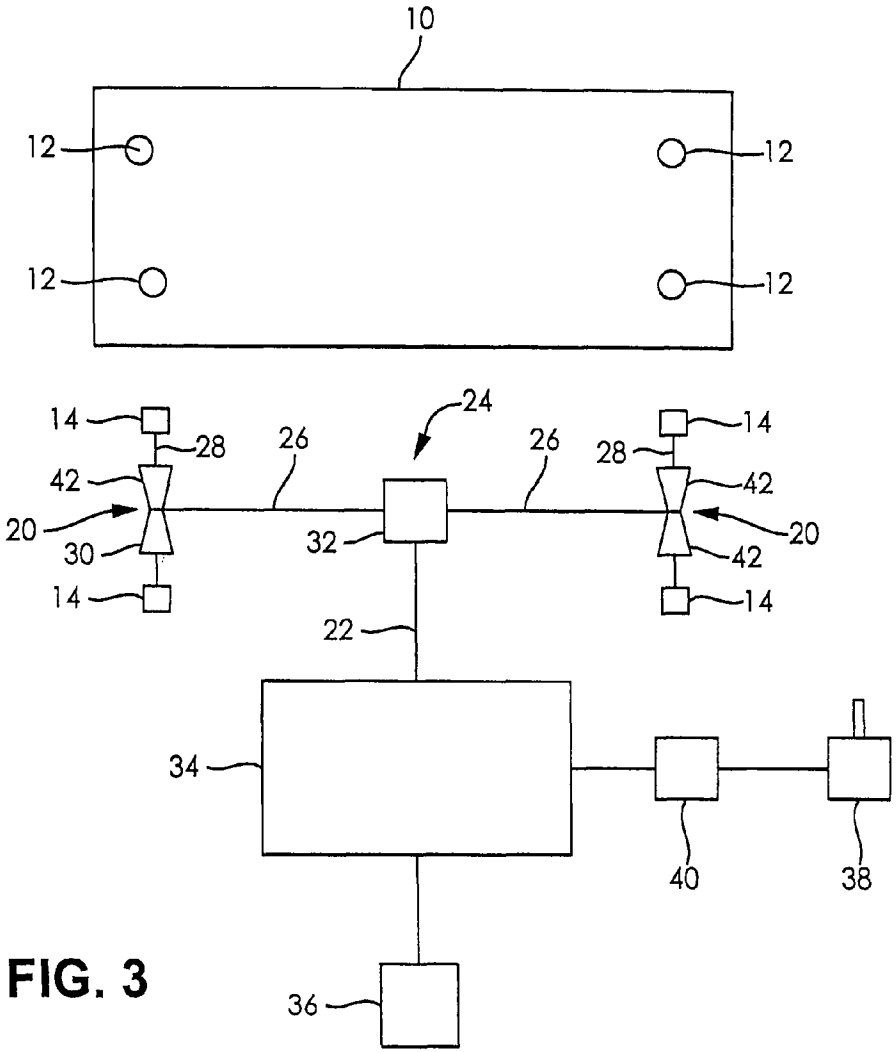
FIG. 3 is a schematic of one embodiment of the device and method described herein adjacent the container of FIG. 1.

The sensor system 20 may be mounted on a reach stacker boom 22, as shown in FIG. 3. The boom 22 may have a telescoping function and be moveable up and down at a variety of angles.

A spreader 24 is attached to the boom 22. The spreader attachment to the boom 22 may permit the spreader 24 to move side to side, vertically and/or at an angle with respect to the boom 22. The spreader 24 has arms 26 extending transverse to the boom 22. Cross pieces 28 are located at the end of each arm 26. At least one twistlock 14 is located on each cross-piece 28. At least one sensor 30 can be located adjacent each twistlock 14.

The sensor system 20 can also comprise inclination sensors which can provide information regarding the position and the angle of the boom 22. The inclination sensors measure angle of slope, or tilt, such as elevation or depression of the boom with respect to gravity. The information from the inclination sensors, in combination with a control algorithm, can calculate the position and angle of the boom 22 based on prior vehicle information, including the size and/or length of each component in an original position.

The sensor system 20 can also comprise proximity sensors, such as inductive sensors, ultrasonic sensors, or radar sensors, by which some specific features (e.g. distance or presence) of the container 10 can be recognized, when the sensors are appropriately located.

The choice between various sensors will mainly depend on the tradeoff between accurate monitoring and reliability and added system cost. The accuracy can be further increased by fusing data from multiple sensors, such as through Kalman filtering or stereo vision, and/or multiple types of sensors.

Regardless of the type of sensor, a signal from the sensor can be processed such as with microcontrollers, or programmable digital hardware for signal conditioning, for image processing and feature recognition in case of a camera, or distance calculation in case of a ultrasonic sensor. The processed signal is sent from the first processor 32 to a second processor 34 for higher level control of the system.

The data from the chosen sensor, or the "direct fusion" of multiple sensor data, is sent to the second processor 34 to calculate an appropriate locking trajectory for the spreader 24. An appropriate locking trajectory takes into account safety, speed and accuracy. Safety considerations include the safety of the containers 10 and their contents, safety of the machine, objects in the environment and people. Speed considerations are those that make this an efficient process by increasing the speed of container locking over prior methods. Accuracy considerations relate to the time it takes to position the twistlocks 14 accurately within the holes 12 on the container 10.

The sensor data, which will include the relative position and angle of the container 10 with respect to the boom 22, is used to determine the necessary actuation, such as electro-hydraulic actuation, hydraulic, pneumatic actuation, for the boom 22 and/or attached spreader 24 to create a sensed locking trajectory. The sensed locking trajectory is a generated trajectory based on sensed information.

Calculating the sensed locking trajectory may comprise several algorithmic steps in a cascaded controller structure. The steps may include calculating the distance to the point to be reached. Based on the extracted image features and sensor information, the relative position of the spreader 24 to the twistlock holes 12 is determined. Next, the reference trajectory to move the spreader 24 to the twistlock hole 24 is calculated. A path planning approach can be used, balancing the fast approach of the goal with smooth movements, which lends itself to low acceleration. Next, a closed-loop control of the actual spreader 24 position compared to the reference trajectory is made. To increase robustness and facilitate real-time application different types of closed-loop control can be used, such as predictive or online-optimal control, or PI-control. In each case, once a position of the twistlock hole 12 is determined, that position is tracked through the trajectory.

Based on the foregoing, it can be appreciated that one mode of operation comprises automatic locking. The automatic locking mode is used when the operator provides no commands or the commands are not clear. In this mode, a controller 36, which may be hydraulic, pneumatic or electro-hydraulic, moves the twistlocks 14 slowly towards the holes 12 based on the sensed trajectory.

In any mode, a calculated actuator command from the first processor 32 is compared and may be combined with the command of the human operator. The human operator is using controls to move the boom 22 and spreader 24, and actuate the twistlocks 14. Actuation of the twistlocks can also be automatic once the twist locks are positioned in the twistlock holes.

The controls may be such as one or more joysticks 38 held by the operator used to control the boom elevation, angle and position, and side to side movement of the spreader 24. Inputs provided from the operator are sent to an operator input sensor 40 to create an operator created trajectory. The operator trajectory includes an operator created position and an operator created angle of the twistlock hole 12 with respect to the twist lock 14.

The sensed trajectory and the operator trajectory can be combined in whole, in part or not at all. To determine how much of a particular trajectory will be used, the trajectories are compared to one another and to other set points and priorities. The comparison may be done within the second processor 34.

The processor 34 is programmed with operational set points and priorities. For example, the operator trajectory is given a stronger weight than the sensed trajectory as long as it falls within a threshold of the sensed trajectory. An acceptable threshold may be, by way of example, within 20 percent of the sensed trajectory. Thus, the operator trajectory is selected for the machine if a first difference between the operator trajectory and the sensed trajectory does not exceed a first predetermined limit.

Even if the operator trajectory is given priority, the sensed trajectory can still assist the operator. For example, the sensed trajectory can be used to assist the operator move the joystick 38 in the correct position. The assistance can be in the way of movements of the joystick 28 by the joystick controls in the preferred direction of movement or even resistance by the joystick to certain undesired operator movements.

Assistance can be deferred, or overridden, by the operator if there is a significant difference between the trajectories. What comprises a significant difference can be based on predetermined thresholds for, by way of example, boom 22 position and spreader 24 position. Circumstances that may warrant overriding assistance may be when the operator perceives a hazardous situation, such as an imminent collision between the spreader 24 and another object, such as a container 10, other material handling equipment, etc., or an incorrect twistlock hole 12 detection. The operator override is also useful in situations where external conditions result in unexpected movements of the spreader 24, such as gusty winds, or that inhibit the correct twistlock hole 12 detection, such as a surface covered by snow. Thus, the operator trajectory is selected for the machine if a second difference between the operator trajectory and the sensed trajectory exceeds a second predetermined threshold.

Appropriate signals to one or more controllers 36 are sent by the second processor 34 based on the selected trajectory. The controllers 36 may be such as hydraulic or pneumatic controllers for the boom 22, spreader 24 and/or twistlocks 14.

Based on the above, two additional modes of operation of the system can be appreciated. A second mode comprises a shared control mode. In shared control mode, the controller reinforces or reduces the operator input to obtain a fast and accurate locking.

A third mode of operation comprises an override control mode. In the override control mode, the operator demands extreme movements, which may be such as a long-time request or a high-amplitude request, and the shared control is switched to pure operator control. This is used to mitigate potentially hazardous situations described above.

In any of the operational modes, the signal from the second processor 34 to the controller 36 can be replaced, or supplemented, by indicator signals, such as LEDs or arrows on a small display in order to guide the operator, who stays fully in control.

FIG. 3 depicts one embodiment comprising a set of cameras 42. The camera set may be such as an array of 4 cameras, or 2 wide-angle cameras closer to the spreader 24 center to monitor the area around the twistlocks 14. While one orientation and number of cameras is depicted in FIG. 3, the number of sensors, the type of sensors, and the orientation of the sensors can change.

If the operator maneuvers the spreader 24 close to a container 10 surface, the processing unit tries to identify the position of the twistlock holes 12. This may be done by combining the distance information between the spreader 24 and the container 10 with typical circle detection algorithms on image processing. Alternatively, the edges or corners of the container 10 can be detected from the camera 42 images or by an array of proximity sensors, or a single proximity sensor which is moved in search of the edge, and the twistlock hole positions are subsequently calculated based on the standardized size of the container. This data is used in the processing, together with the operator input, to send a signal to the actuator(s).

The system can be expanded with a learning algorithm to improve the trajectory to the twistlock holes, based on the operator input and time-to-lock. By way of example, the controller can track the trajectories and keep them in memory. The controller can access the remembered trajectories and develop patterns using learning algorithms. The patterns can be used in all or parts of the vehicle operation. The patterns can be used to pre-activate some of boom or spreader movements.

One example of pre-activation might be based on the system learning that the operator prefers to move forward first and then side ways to align the twistlocks with the twistlock holes, or vice versa. The system can pre-activate the vehicle to move in this regard.

Figure 4:
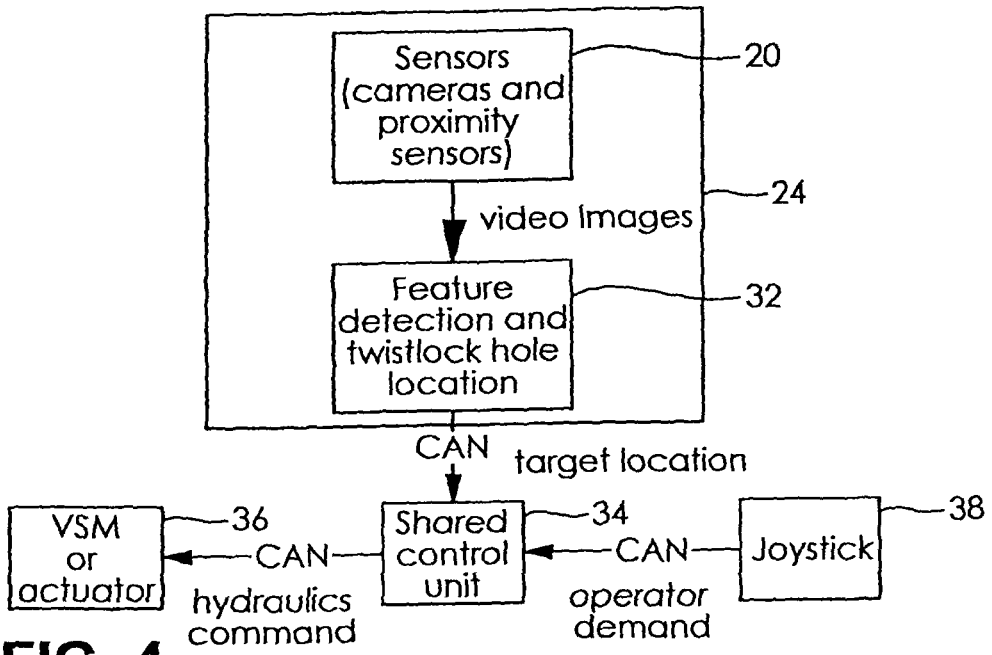
FIG. 4 is a schematic representation of one embodiment of a sensor, control unit, operator input and actuator.

FIG. 4 schematically represents one embodiment of the machine. A sensor system 20 comprised of cameras 42 and/or proximity sensors are located on the spreader 24. The data from the system 20 is sent to feature detection and twistlock hole location processor, which is the first processor 32 discussed above. The data from the processor 32 is sent over a Controller Area Network (CAN) bus to a shared control unit, which can be the second processor 34. The shared control unit also receives data from the operator controlled joystick 38, such as via a CAN bus. The shared control unit outputs a command, such as a hydraulic actuation command, via a CAN bus, to a vehicle system manager (VSM) or to a controller 36 for the spreader 34 and/or boom 22. The sensor system 20 and processor 32 are both integrated into the spreader 24. While a Can bus is discussed, it can be appreciated that other protocol can be used to transfer the data to the various locations discuss above.

Figure 5:
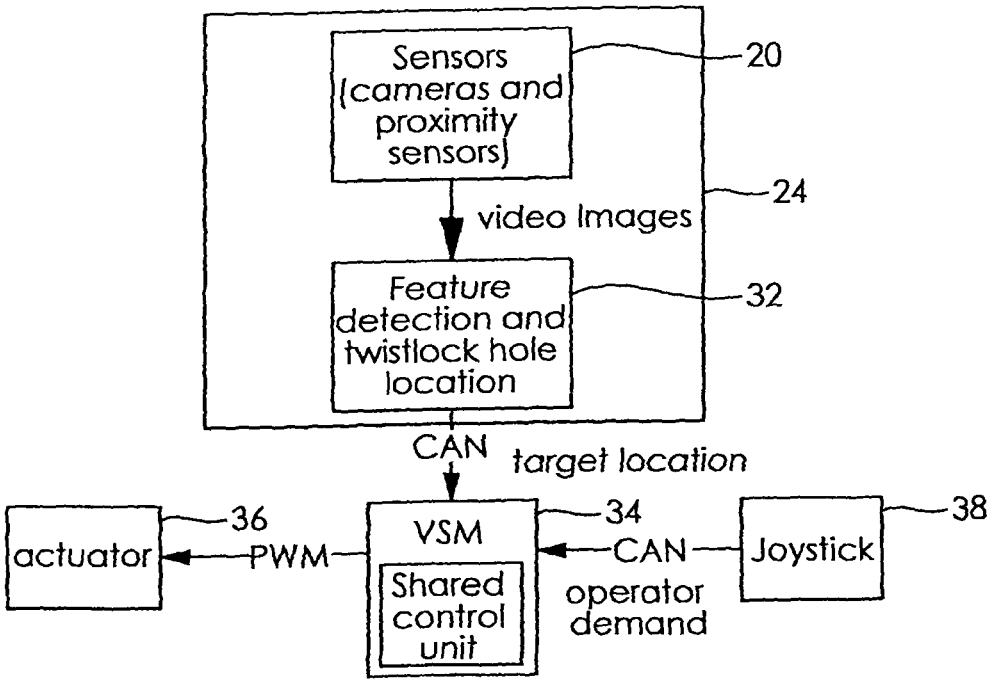
FIG. 5 is a schematic representation of another embodiment of a sensor, control unit, operator input and actuator.

FIG. 5 has the features discussed above in FIG. 4, except the VSM and the shared control unit are combined and shared control algorithms are implemented on the shared control unit.

Figure 6:
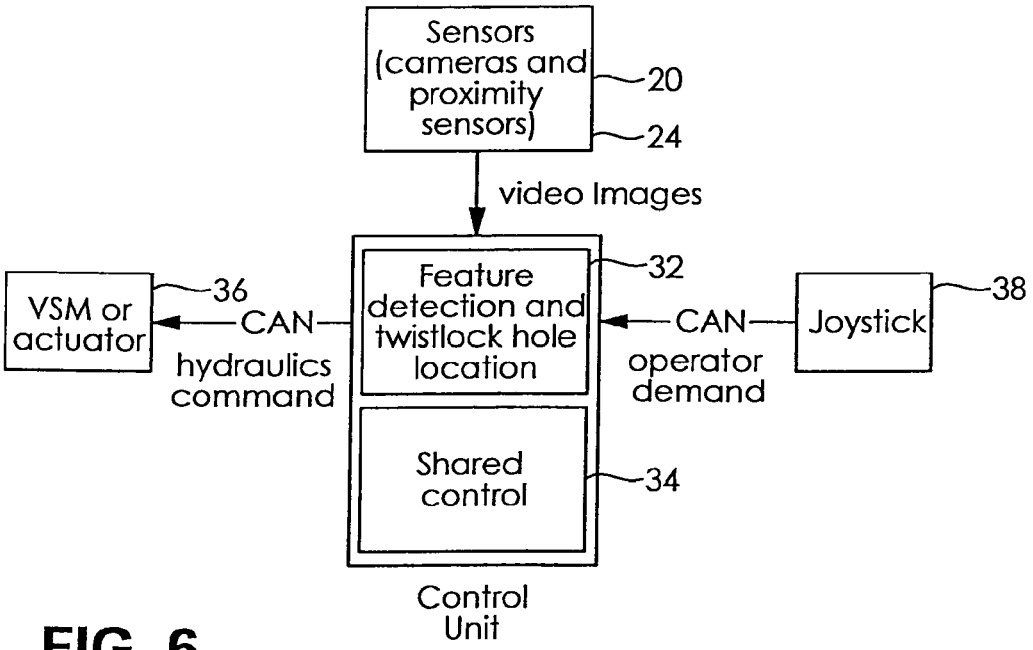
FIG. 6 is a schematic representation of yet another embodiment of a sensor, control unit, operator input and actuator.

FIG. 6 has the features discussed in FIG. 4 except the processor 32 is coupled with the shared controller instead of being located on the spreader 24.

The method and device allow the operator to perform a faster locking of the container and reduces the training needed to successfully perform the locking operation. During the whole operation the control is shared between the operator and the digital controller. As the system is not fully automatic, the operator stays in control and hazardous situations can be avoided. The method can use cheaper sensors and implementation than the state of the art, is much more automated and increases safety.

What is claimed is:

1. A method for selecting a trajectory, comprising:

using at least one twistlock sensor on a machine to sense a location of a twistlock hole on an object;

transmitting said sensed location to a processor to calculate a sensed trajectory for a twistlock to engage said twistlock hole;

using at least one operator input sensor to sense an input from an operator moving a joystick to engage said twistlock in said twistlock hole;

transmitting said sensed operator input to said processor to calculate an operator trajectory for said twistlock to engage said twistlock hole;

comparing said sensed trajectory with said operator trajectory to give said operator trajectory priority over said sensed trajectory if a first difference between said operator trajectory and said sensed trajectory does not exceed a first predetermined limit or if a second difference between said operator trajectory and said sensed trajectory exceeds a second predetermined threshold;

determining how much of said sensed trajectory and said operator trajectory will be used to locate said twistlock into said twistlock hole in said object;

locating said twistlock in said twistlock hole based on a trajectory determined from said sensed trajectory and said operator trajectory and actuating said twistlock in said twistlock hole.

2. The method of claim 1, wherein said at least one twistlock sensor is affixed to said machine and is selected from the group consisting of a camera, an inclination sensor, ultrasonic sensor, and a proximity sensor.

3. The method of claim 1, wherein at least one twistlock sensor is used for said twist lock.

4. The method of claim 1, wherein said at least one twistlock sensor can detect a presence of and distance to said twistlock hole.

5. The method of claim 1, wherein said sensed trajectory includes a sensed trajectory position and a sensed trajectory angle of said twistlock hole with respect to said twistlock.

6. The method of claim 1, wherein said operator trajectory includes an operator created position and an operator created angle of said twistlock hole with respect to said twistlock.

7. The method of claim 1, wherein said at least one operator input sensor is connected to a joystick controller within a vehicle, said joystick controller providing operator twistlock trajectory position and operator trajectory angle data.

* * * * *